US006532352B2

(12) United States Patent
Katsuyama

(10) Patent No.: US 6,532,352 B2
(45) Date of Patent: Mar. 11, 2003

(54) POWDER CONTAINER AND IMAGE FORMING APPARATUS USING SAME

(75) Inventor: Goro Katsuyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/886,108

(22) Filed: Jun. 22, 2001

(65) Prior Publication Data

US 2002/0009311 A1 Jan. 24, 2002

(30) Foreign Application Priority Data

Apr. 23, 2001 (JP) ..... 2001-124312
Jun. 22, 2002 (JP) ..... 2000-188135

(51) Int. Cl.[7] ..... G03G 15/08

(52) U.S. Cl. ..... 399/262; 222/DIG. 1; 399/120

(58) Field of Search ..... 222/DIG. 1, 325, 222/386.5; 399/106, 120, 262, 263

(56) References Cited

U.S. PATENT DOCUMENTS 4,523,615 A 6/1985 Feenstra et al.
5,392,963 A * 2/1995 Kelly et al. ..... 222/325

FOREIGN PATENT DOCUMENTS

| | | |
|---|---|---|
| EP | 0 627 673 | 12/1994 |
| EP | 1 129 961 | 9/2001 |
| EP | 1 154 333 | 11/2001 |
| JP | 61-138970 | 6/1986 |
| JP | 2000-238843 | 9/2000 |

OTHER PUBLICATIONS

B. S. Kudsi, et al., IBM Technical Disclosure Bulletin, vol. 15, No. 3, pp. 755 and 755a, "Packaging Container for Powder Material", Aug. 1972.

D. J. Lasher, et al., IBM Technical Disclosure Bulletin, vol. 13, No. 11, p. 3218, "Lid Assembly", Apr. 1971.

* cited by examiner

*Primary Examiner*—Hoang Ngo
(74) *Attorney, Agent, or Firm*—Oblon, Spivak, McClelland, Maier & Neustadt, P.C.

(57) ABSTRACT

A toner container includes a deformable toner bag for containing a toner, and a case which has an inner space large enough to house the toner bag and which has higher rigidity than the toner bag. The case is provided with an opening through which the inner bag is attached to and detached from the case.

41 Claims, 13 Drawing Sheets

POWDER CONTAINER AND IMAGE FORMING APPARATUS USING SAME

CROSS-REFERENCE TO RELATED APPLICATIONS

This application is related to and claims benefit of priority, based upon 35 U.S.C. §119, from Japanese Patent Application No. 2000-188135, filed in the Japanese Patent Office on Jun. 22, 2000, and Japanese Patent Application No. 2001-124312, filed in the Japanese Patent Office in Apr. 23, 2001, the entire contents of both Japanese Patent Applications are hereby incorporated by reference herein.

BACKGROUND OF THE INVENTION

1. Field of the Invention

The present invention relates to a powder container for containing powder, e.g. a toner or a developer, and an image forming apparatus using the container.

2. Discussion of the Background

Conventionally, in an image forming apparatus such as a printer, copy machine, or facsimile, a toner container for containing a powder toner has been formed of such a hard bottle as a cartridge or bottle, thus suffering from a problem of discarding the container which is exhausted. That is, an exhausted toner container must be withdrawn from a user to a manufacturer, who has to then wash it if it is to be refurbished or recycled. However, the toner generally cannot completely be washed off the toner container. Accordingly, the exhausted toner containers are presently generally dumped to a dumping site or burned as garbage. Because the toner container is generally bulky, the operation cost of collecting the toner container from a user to the manufacturer is relatively high.

To reduce the cost of collecting the toner container, there has been made a suggestion for the toner container that can reduce the volume thereof.

Such a volume-reducible toner container, however, has not been able to maintain the replenishing performance in a stable manner when replenishing a toner therefrom using a toner replenishing apparatus. Moreover, there has been made a suggestion that such a volume-reducible container should be used only in transportation. The suggestion, however, has not been put into practical use because it suffers from, for example, a problem of contamination due to splashing of the toner at the time of placing the toner into a hard bottle or a toner hopper of a copying machine.

The inventor of the present application has suggested a toner container that can mitigate the above-mentioned problems. This toner container has a bag-in-box configuration that includes a case made of a rigid material and a flexible inner bag which contains the toner and which is housed in the case. After use, this toner container can be greatly reduced in volume, because the toner is contained in the flexible inner bag, and the case is capable of being folded. Thereby, the transportation cost is significantly decreased. Further, when the toner container is mounted to a copying machine, because the flexible inner bag is housed in the rigid case, the inner bag can be protected by the case against an external impact. Furthermore, the toner container has other advantages such as good handling performance due to the rigid case.

Although the bag-in-box type toner container is thus preferable, there is need for further simplifying such work as attaching and detaching the inner bag to and from the case and permitting anyone to properly fold the case after use.

SUMMARY OF THE INVENTION

The present invention has been made in view of the above-discussed and other problems and addresses the above-discussed and other problems.

Accordingly, preferred embodiments of the present invention provide a novel powder container in which an inner bag can be simply attached to and detached from a case and in which the case can be simply and securely folded by any one, and an image forming apparatus using the powder container.

According to a preferred embodiment of the present invention, a powder container includes a deformable inner bag for containing powder, and a case which has rigidity higher than that of the inner bag and which has an inner space capable of housing the inner bag therein. The case has an opening through which the inner bag can be attached and detached. Thus, the inner bag can be easily replaced through the opening.

In the above powder container, the case may be a polyhedron having four face plates or more, and also the opening may be formed at a position corresponding to one or more of those face plates, which are large enough to form the opening such that the inner bag passes therethrough in one direction so as to be attached to and detached from the case.

According to another preferred embodiment of the present invention, a powder container includes a deformable inner bag for containing powder, a case which has rigidity higher than that of the inner bag and which has an inner space capable of housing the inner bag therein. An opening is formed in the case for attaching and detaching the inner bag therethrough, and a door member for opening and closing the opening is provided. The inner bag is more securely protected because the opening of the case is provided with the door member.

The powder container may include a holding device to hold the above-mentioned door member in a closed state.

Further, in the powder container, the above-mentioned case may be a polyhedron having four face plates or more, and the above-mentioned opening may be formed at a corresponding position of one or more of those face plates, which are large enough to form the opening such that the inner bag passes therethrough from one direction so as to be attached to and detached from the case, and the above-mentioned door member is the face plate provided at the position corresponding to the above-mentioned opening.

The above-mentioned case in a polyhedron can be developed in a plate shape and the above-mentioned door member may be the face plate that is closed when the above-mentioned case is assembled.

Furthermore, one side of the above-mentioned door member may be mounted to the case in a rotatable manner and the other side thereof may be engaged with the case in an engaging/disengaging manner. Further, the above-mentioned holding device may be a sheet material provided in such a manner as to pass the engaging side of the door member.

The above-mentioned sheet material may be wound in such a direction as to pass the rotating side and the engaging side of the above-mentioned door member.

Furthermore, the above-mentioned sheet material may have information about use written on its surface.

Furthermore, a portion of the above-mentioned case covered by the above-mentioned sheet material may have information about disassembling of the case written thereon.

Furthermore, the portion of the above-mentioned case covered by the above-mentioned sheet material may have an auxiliary shape for disassembling of the case formed thereon.

Moreover, the above-mentioned sheet material may be provided with a portion for promoting cutting thereof in a direction different from its winding direction.

In addition, the above-mentioned cutting promoting portion may be provided on the face plate in the case, which is provided adjacent the engaging side of the above-mentioned door member and in the vicinity of the engaging side of the door member.

Furthermore, the orientation of the sheet material where the above-mentioned cutting promotion portion starts to cut the sheet material and a portion of the inner bag at which the powder is discharged may be in the same direction.

Moreover, the above-mentioned sheet material may be paper or a film.

In addition, a member for determining a position at which the above-mentioned sheet material is wound is provided for the above-mentioned case.

Furthermore, one side of the above-mentioned door member may be mounted to the above-mentioned case in a rotable manner and the other side of the door may be engaged with the case in an engaging/disengaging manner, and, in addition, the above-mentioned holding member may be a seal pasted to the engaging side of the above-mentioned door member.

Moreover, the above-mentioned seal may be pasted over a boundary between the above-mentioned door member and the face plate adjacent the engaging side of the door member.

According to another preferred embodiment of the present invention, an image forming apparatus includes a developing device and a powder container. The powder container includes a deformable inner bag for containing powder, and a case having an inner space large enough to house the inner bag. The case has higher rigidity than the inner bag. The case has an opening through which the inner bag is attached to and detached from the case. The powder container contains toner, and the toner is replenished to the developing device from the container.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DESCRIPTION OF THE PREFERRED EMBODIMENTS

Figure 1:
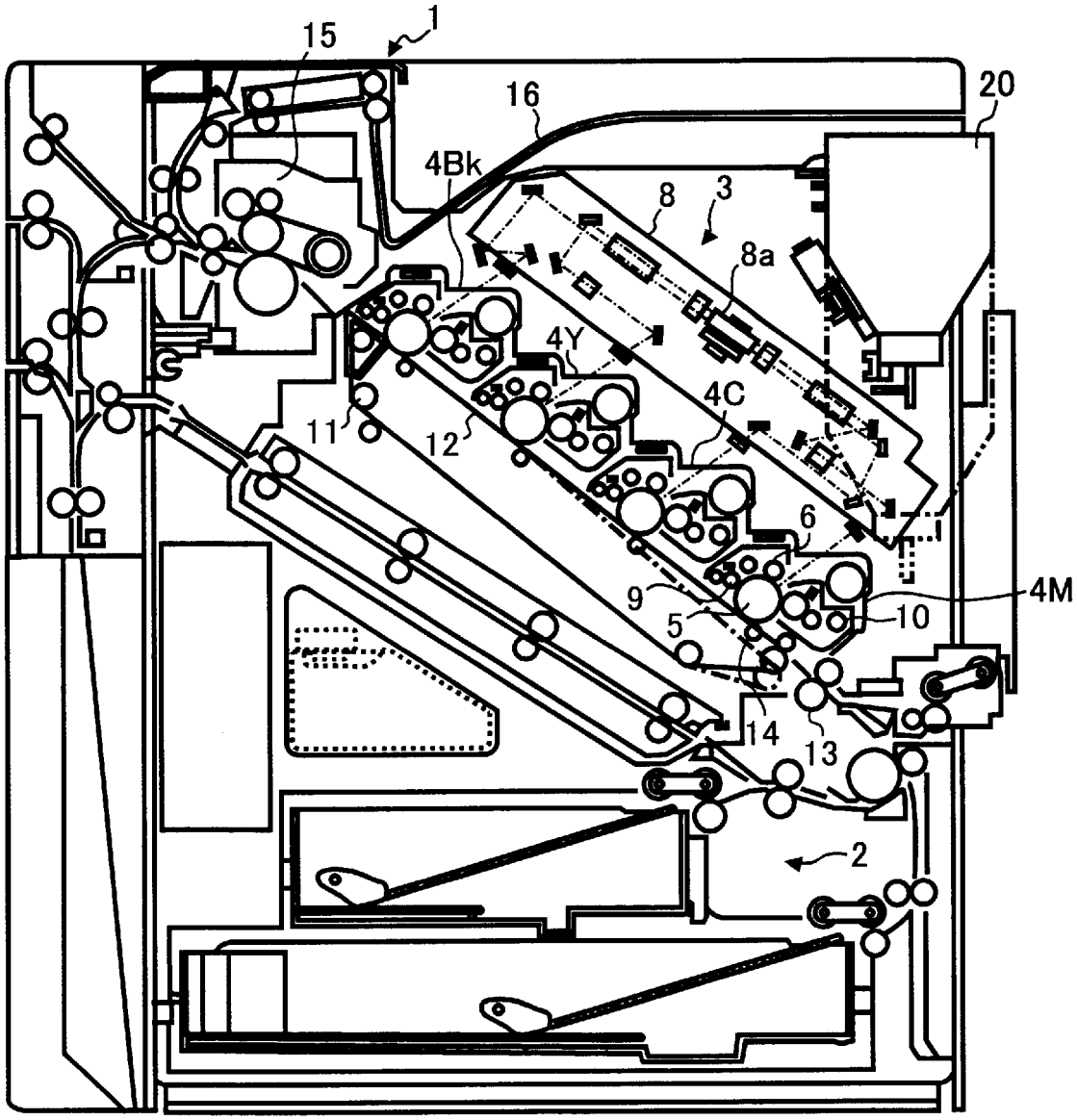
FIG. 1 is a schematic diagram illustrating an image forming apparatus related to the present invention.

Referring now to the drawings, wherein like reference numerals designate identical or corresponding parts throughout the several view, preferred embodiments of the present invention are described.

FIG. 1 is a schematic diagram for illustrating a color laser printer as an example of an image forming apparatus provided with a tone replenishing apparatus using a toner container according to a preferred embodiment of the present invention. The color laser printer has such a configuration that a sheet feeding portion 2 is disposed below an apparatus body 1, and an image making portion 3 is disposed above the apparatus body 3. The image making portion 3 is provided with a transferring belt apparatus which is disposed slantingly so that its sheet feeding side may face downward and its sheet discharging side may face upward. The transferring belt apparatus has an endless transferring belt 12 wound over a plurality of, four being shown in this embodiment, belt wheels 11. Four image making units, 4M, 4C, 4Y, and 4Bk, respectively corresponding to magenta (M), cyan (C), yellow (Y), and black (Bk) colors are disposed in parallel from the bottom in this order on an upper traveling side of the transferring belt 12.

Figure 2:
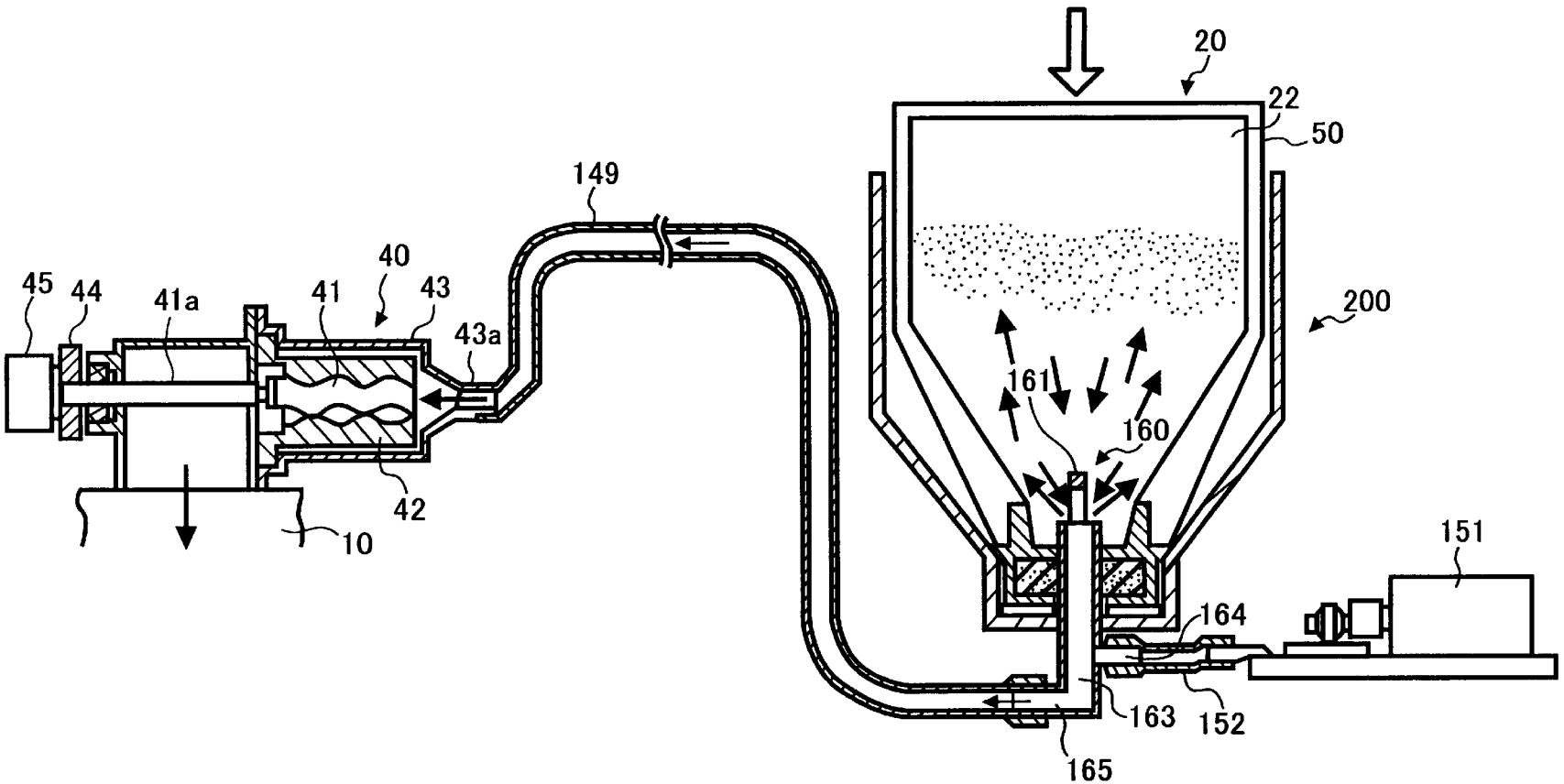
FIG. 2 is an illustration for explaining a toner replenishing mechanism of the image forming apparatus.

As illustrated in FIGS. 1 and 2, the image making units 4M, 4C, 4Y, and 4Bk are each provided with a photosensitive drum 5 acting as an image bearer, which is driven in rotation clockwise by a driving device not shown. Around the photosensitive drum 5 are provided a charging roll 6 acting as a charging device, a developing apparatus 10 acting as a developing device, and a cleaning apparatus 9 acting as a cleaning device. Optical writing is carried out on a surface of the photosensitive drum 5 by use of a laser light by an optical writing apparatus 8. The developing apparatus 10 is a two-component developing apparatus using a two-component developer comprising a toner and a carrier. The development apparatus 10 is supplied with the toner from a later described toner replenishing apparatus as the toner in the developing apparatus 10 is consumed.

Now, the operation of forming a full-color image with the color printer illustrated in FIG. 1 is described with reference to the magenta-color image making unit 4M.

An optical image to be developed by a magenta toner is written by the optical writing apparatus 8 on the photosensitive drum 5 charged by the charging roll 6 by driving an LD (laser diode) not shown to thereby apply a laser light to a polygon mirror 8*a* in order to guide a reflected light via a cylinder lens onto the photosensitive drum 5. By this writing operation, an electrostatic latent image is formed on the photosensitive drum 5 based on image data sent from a host machine such as a personal computer, and then the latent image is developed into a visual image of the magenta toner by the developing apparatus 10.

At the same time, a sheet specified as a transferring material is fed from the sheet feeding apparatus 2 and is initially butted against a registration roller 13 disposed on the upstream side in the conveying direction of the transferring belt 12. Then, the sheet is fed onto the transferring belt 12 in synchronization with the above-mentioned visual image. As the belt 12 travels, the sheet is guided to a transferring position opposing the photosensitive drum 5. At this transferring position, the magenta toner visual image is transferred to the sheet by a transferring roll 14 disposed on the back side of the transferring belt 12.

The above-mentioned image making operation is likewise carried out for each of the other image making units 4C, 4Y, and 4Bk, thus forming visual images by use of the other colors of the toner on their respective photosensitive drums 5. The visual images are then transferred one on another each time the sheet is conveyed to each transferring position by the transferring belt 12. Thus, the color printer can form a full color image on a sheet in almost the same short time as required for a monochrome image. The sheet after transferring is released from the transferring belt 12 and undergoes fixing at a fixing apparatus 15. The sheet after fixing is then discharged from the machine. The sheet is typically reversed and discharged into a sheet discharging tray 16 provided on the upper face of the apparatus body 1. This reverse discharging function is almost an indispensable condition for the printer to arrange prints in a page order.

Next, a description will be made with respect to the toner replenishing apparatus which replenishes each of the image making units 4M, 4C, 4Y, and 4Bk with the toner contained in respective toner containers 20M, 20C, 20Y, and 20Bk, with reference to FIG. 2. The toner replenishing apparatuses for replenishing the toner to the image making units 4M, 4C, 4Y, and 4Bk have essentially the same construction.

The developing apparatus 10 is provided with a suction type powder pump 40, which is a single-shaft eccentric screw pump, in its vicinity or in an integrated manner. As illustrated in FIG. 2, the powder pump 40 includes a rotor 41 made of a rigid material such as metal in an eccentric screw shape, a stator 42 made of an elastic material such as rubber in a double-threaded screw shape, and a holder 43 made of a resin material, which encloses the rotor 41 and the stator 42 and which forms a conveying path for powder. The above-mentioned rotor 41 is driven in rotation via a gear 44 integrally linked to a drive shaft 41*a* linked with a pin joint. Reference numeral 45 here indicates an electromagnetic clutch, which controls operation of the powder pump 40.

Furthermore, the above-mentioned holder 43 is provided at its tip, i.e. the right end in FIG. 2, with a toner inlet 43*a*, which is connected via a toner delivering tube 149 to a toner connecting mouth 165 provided to a nozzle 160 described later. Preferably, the toner delivering tube 149 may be formed in a flexible tube with a diameter of, e.g. 4–10 mm. Further, the toner delivering tube 149 is preferably made of a rubber material excellent in toner resistance (e.g., polyurethane, nitrile, EPDM, silicon, etc). The flexible tube can be piped in any desired direction.

The toner replenishing apparatus as described above is known that the single-shaft eccentric screw pump, which is the powder pump 40, is capable of continuous constant-quantity delivery at a high solid-gas ratio, so that an accurate quantity of a toner can be delivered proportional to the number of revolutions of the rotor 41. Accordingly, when a toner replenishing command is issued in response to, e.g. detection of an image density, the powder pump 40 operates so to replenish the developing apparatus 10 with a requested quantity of the toner.

A setting portion 200 of the image forming apparatus body 1 for setting the toner container 20 thereto is configured as an individual unit separate from the developing apparatus 10. The nozzle 160, which has a circular cross section and which is inserted into the toner container 20, is erected in the setting portion 200. The container 20 is set to the setting portion 200 of the image forming apparatus body 1 from the upper side. The nozzle 160 provided to the setting portion 200 has a single-tube construction. A tip member 161 formed in a cross-sectional cone is formed at the top of the nozzle 160, integrated with the nozzle 160 or fixed to the nozzle 160. The tip member 161 is followed by a path 163 which serves as both an air supply path and a toner supply path. The inside of the nozzle 160 has a single-tube construction, and the path 163 is bent to the left in the figure at the bottom end of the nozzle 160. A toner connecting mouth 35 provided at the end of the nozzle 160 is connected with the toner delivering tube 149. In addition, the path 163 is bent to the right in the figure above the toner connecting mouth 165 and is provided with an air connecting mouth 164.

In this embodiment, the air connecting mouth 164 is connected via an air delivering pipe 152 to an air pump 151, which is provided as an air source in an air supplying apparatus. When the air pump 151 operates, air is ejected from the pump 151 via the air delivering pipe 152 to the toner container 20 from the lower side. Then, the air thus ejected into the toner container 20 agitates and fluidizes the toner as the air passes through the toner.

Figure 3:
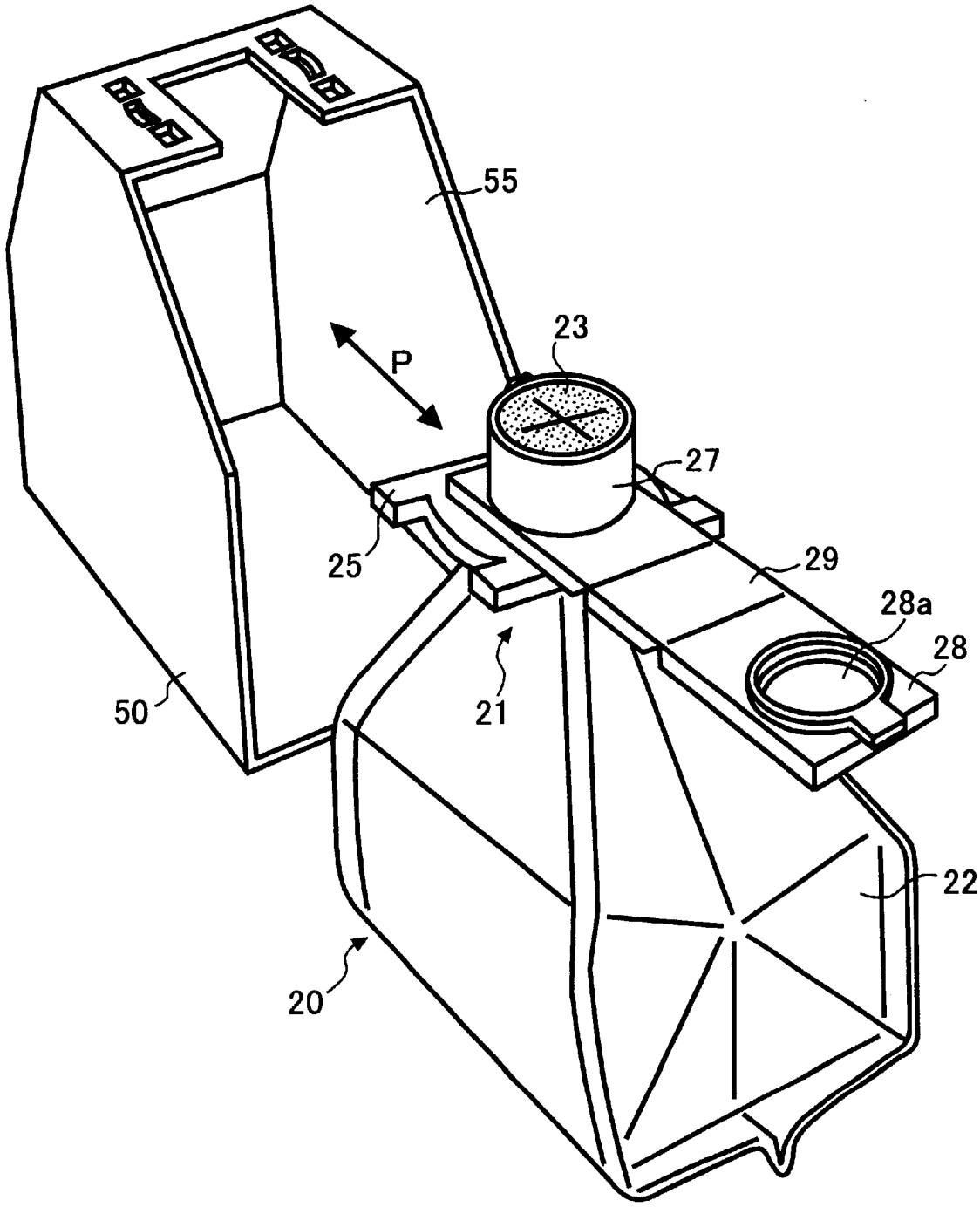
FIG. 3 is a perspective view illustrating a toner container related to the present invention.
Figure 4:
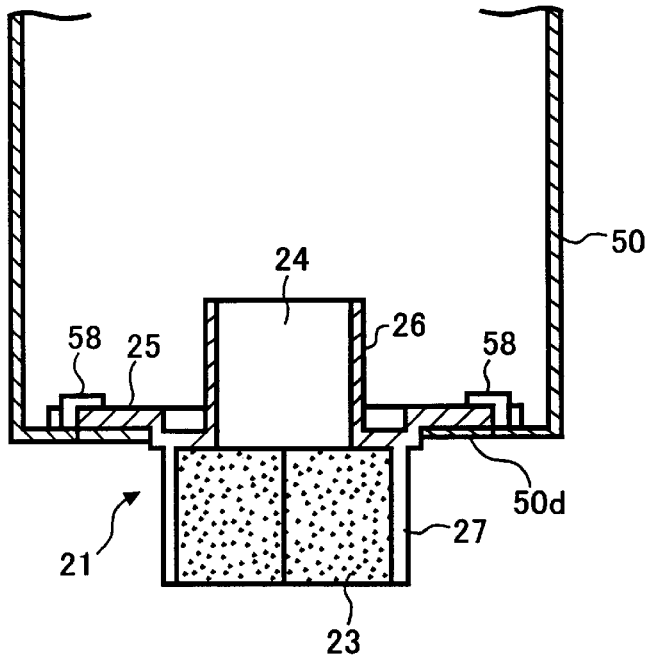
FIG. 4 is a cross-sectional view illustrating a base portion of the toner container.
Figure 5:
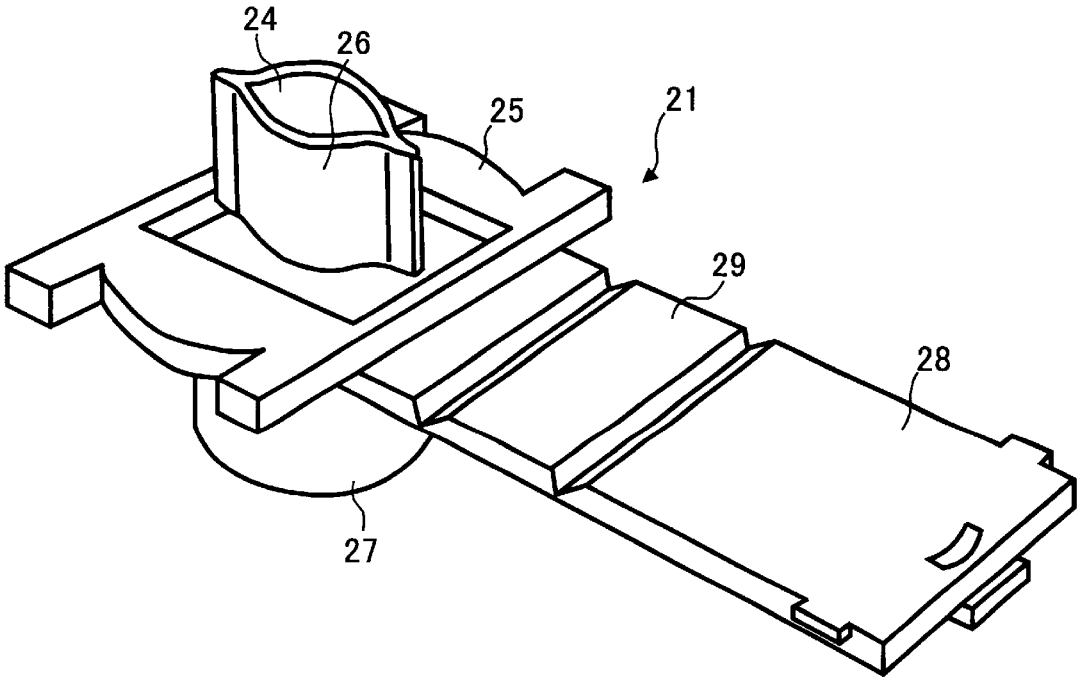
FIG. 5 is a perspective view illustrating the base portion of the toner container.

As illustrated in FIGS. 2 and 3, the container 20 includes a toner bag 22 as the inner bag for containing toner and a case 50 for housing the toner bag 22. The toner bag 22 as the inner bag is formed of a single layer or a plurality of layers of a flexible sheet made of paper or a resin such as polyethylene or nylon to a thickness of, e.g. 80–200 $\mu$m or so. The toner bag 22 is provided with a toner discharging portion. The toner discharging portion is fixed to a base portion 21, which is made of a resin etc. and which is formed by injection molding. As illustrated in FIGS. 4 and 5, the base portion 21 is provided with a vertical through-hole 24 for discharging the toner. A sliding plate 25, which is configured as a linking projection of a linking device formed roughly rectangular, is integrally formed with or fixed on intermediate outer periphery of the through-hole 24. Further, the base portion 21 is provided with a fixing portion 26 formed in a ship shape, to which is fixed the toner bag 22, above this sliding plate 25. A discharging portion 27, which is formed in a barrel shape and in which the above-mentioned through-hole 24 is formed, is provided below the sliding plate 25. The discharging portion 27 is provided with a self-closing valve, e.g. a seal valve 23 made of, e.g. a foaming sponge. The base portion 21 is integrally provided via a linking portion 29 with a cap piece 28 for blocking the discharging portion 27. A circular recess 28*a* which fits into the discharging portion 27 is formed in the cap piece 28.

Now, the case 50 of the toner container 20 is described with reference to FIG. 3. In this embodiment, the case 50 has an inner space large enough to house the toner bag 22. The case 50 is made of a resin or paper which has a higher rigidity than that of the toner bag 22. The case 50 is formed as a polyhedron, for example as an octahedron in this embodiment. The case 50 has an opening 55 formed therein, through which the toner bag 22 is inserted and taken out in an arrow P direction.

In the toner container 20 constructed as described above, because the case 50 has the opening 55 formed therein, the toner bag 22 can be easily replaced by anyone.

Figure 6:
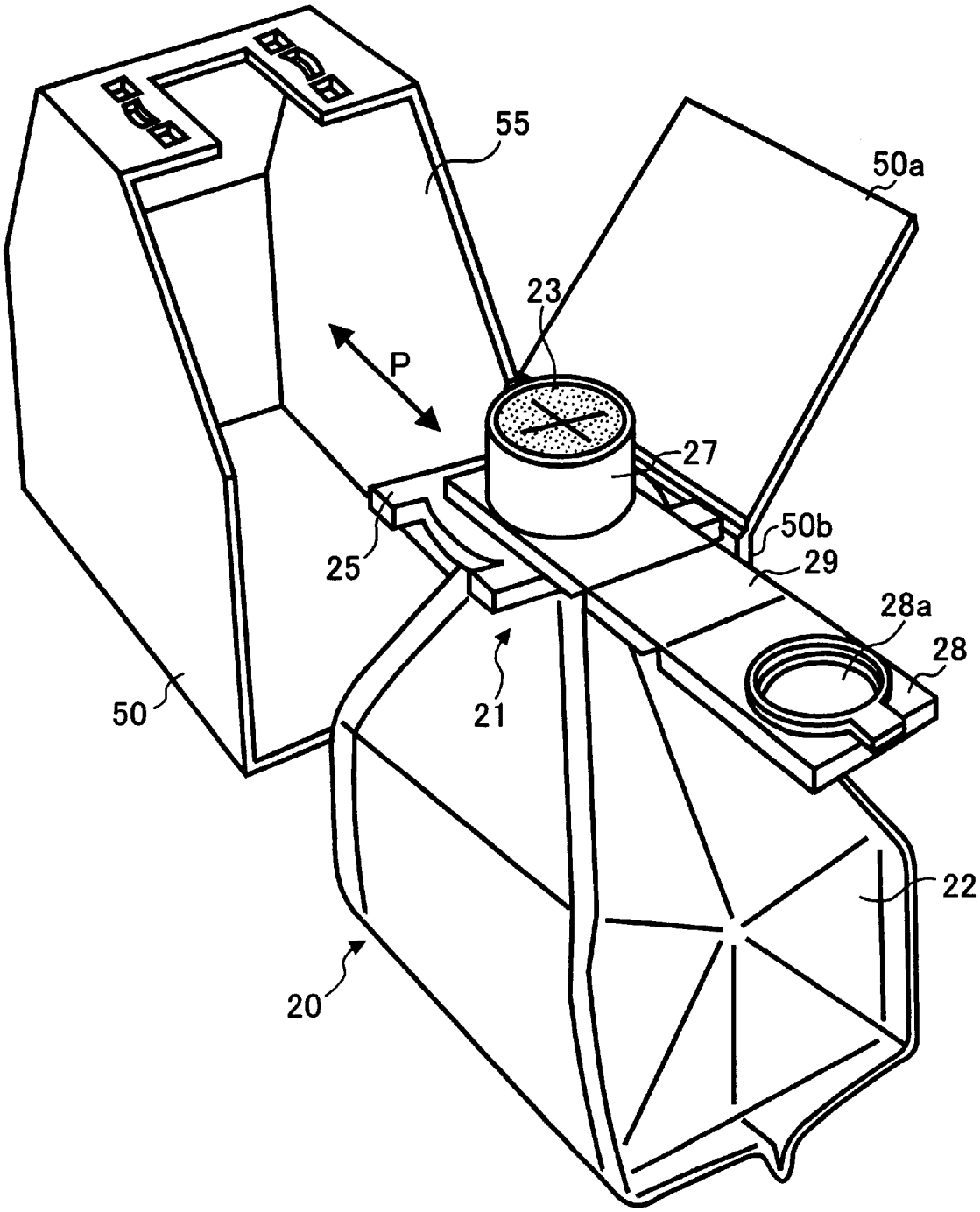
FIG. 6 is a perspective view illustrating another toner container related to the present invention.
Figure 7:
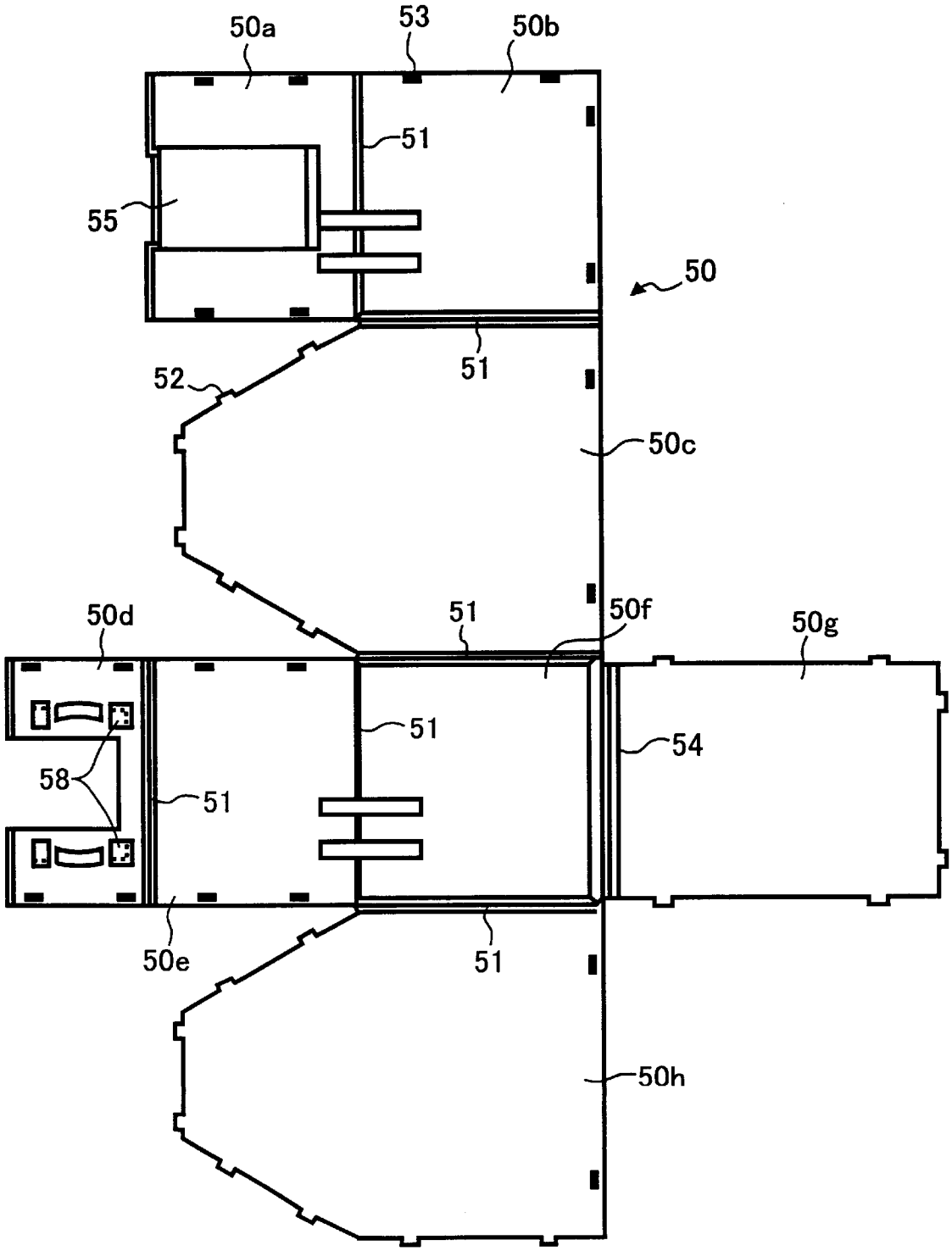
FIG. 7 is a development view on an outer face side of a case of the container.
Figure 8:
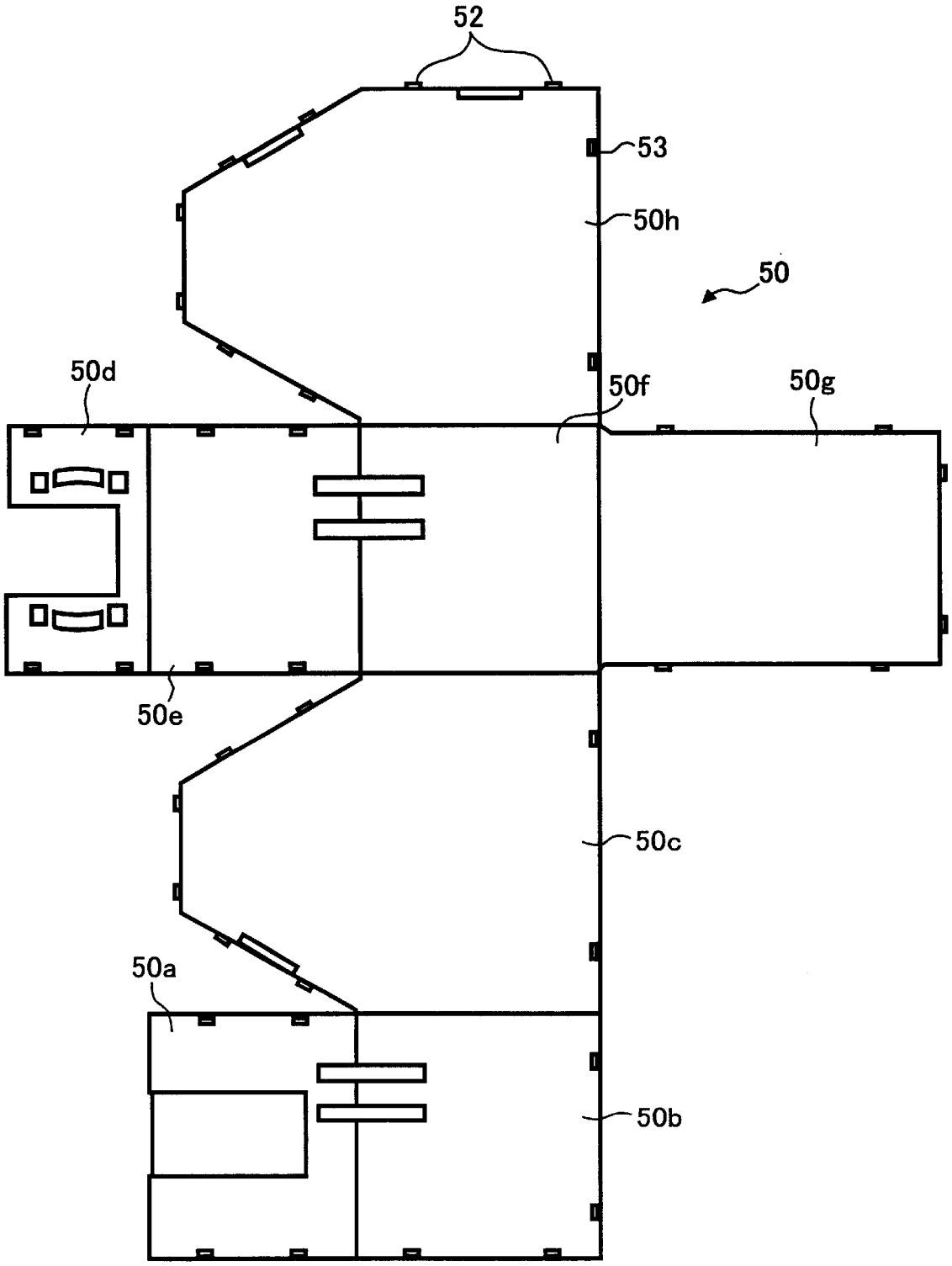
FIG. 8 is a development view on an inner face side of the case.

FIG. 6 is a perspective view illustrating another powder container according to another embodiment of the present invention, in which face plates 50*a* and 50*b* are provided as door members which can be opened and closed in the opening 55. The case 50 is a octahedron, and has face plates indicated by reference numerals 50*a* through 50*h* in FIG. 7 and FIG. 8, which illustrate the inner surface and the outer surface of the case 50 respectively as developed on a flat plate. The face plates 50*a* through 50*h* each have connecting sides which are connected with another plate and disconnecting sides which are disconnected from another plate. The connecting sides and the disconnecting sides are all rectilinear. Each of the face plates 50*a* through 50*h* has at least one connected side. Because at least one connecting side is provided for each of the face plates 50*a* through 50*h*, by appropriately selecting the connecting and disconnecting sides, the case 50 can be developed in a variety of single-plate shapes without causing some of the face plates 50*a* through 50*c* to be disconnected completely from the others when developed on a flat plate.

Figure 9:
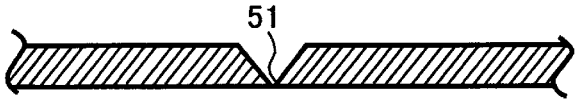
FIG. 9 is a cross-sectional view of a connected portion of two face plates, in which a V-shape groove is formed.
Figure 10:
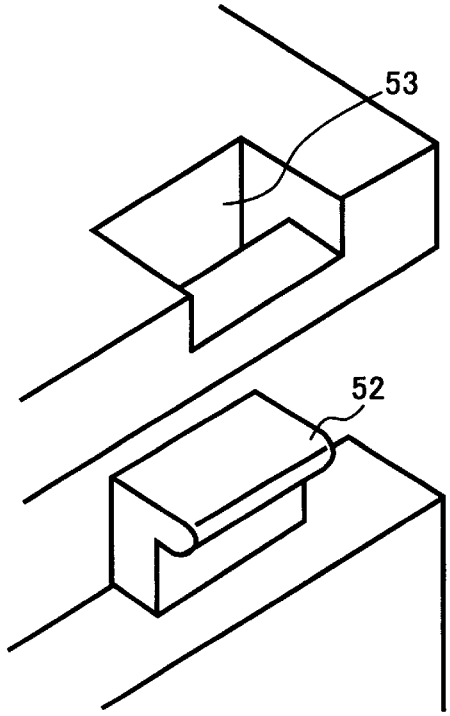
FIG. 10 is a perspective view for explaining an engaging device engaging the face plates of the case.

Further, as illustrated in FIG. 9, a V-shaped groove 51 is formed on the inner surface of each connected portion of the face plates 50*a* through 50*h* for restricting a folding angle at the connected portion of the face plates 50*a* through 50*h*. The angle of the V-shaped groove 51 is set in accordance with the folding angle at each connected portion of the face plates 50*a* through 50*h*. That is, if the V-shape of a V-shaped groove 51 has an angle of about 90 degrees, the face plates connected via this V-shaped groove 51 can be regulated to be folded by the folding angle of about 90 degrees when the V-shape groove forming face plates are folded in the direction that the V-shape groove forming face plates abut against each other. If the V-shape groove forming face plates are folded in a direction that they depart from each other, there is no restriction, so that the face plates are folded until they are superposed one on the other. Moreover, as illustrated in FIG. 10, the disconnecting side of each of the face plates 50*a*–50*h* has, as an engaging device, an engaging protrusion 52 on one face plate and an engaging hole 53 in the other face plate, so that the face plates can be engaged with each other. Accordingly, the case 50 can be formed, without using tools etc., by folding the face plates 50*a*–50*h*, which are in a state where they are developed in one plate, in an appropriate order in the direction that the inner surfaces thereof abut against each other, and by fitting the engaging protrusion 52 and the engaging hole 53 of respective disconnecting sides of the face plates 50*a*–50*h* with each other.

Figure 11:
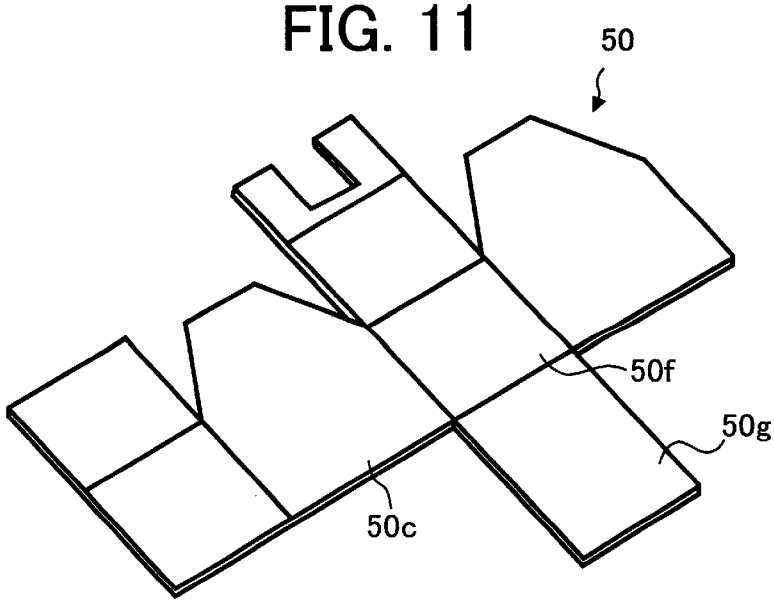
FIG. 11 is a perspective view for explaining a procedure for folding the case.
Figure 12:
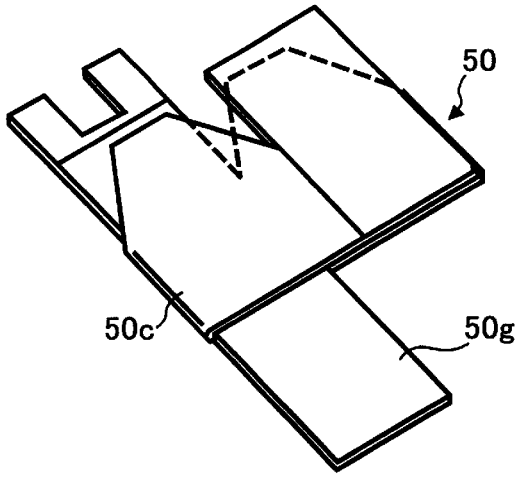
FIG. 12 is another perspective view for explaining the procedure for folding the case.
Figure 13:
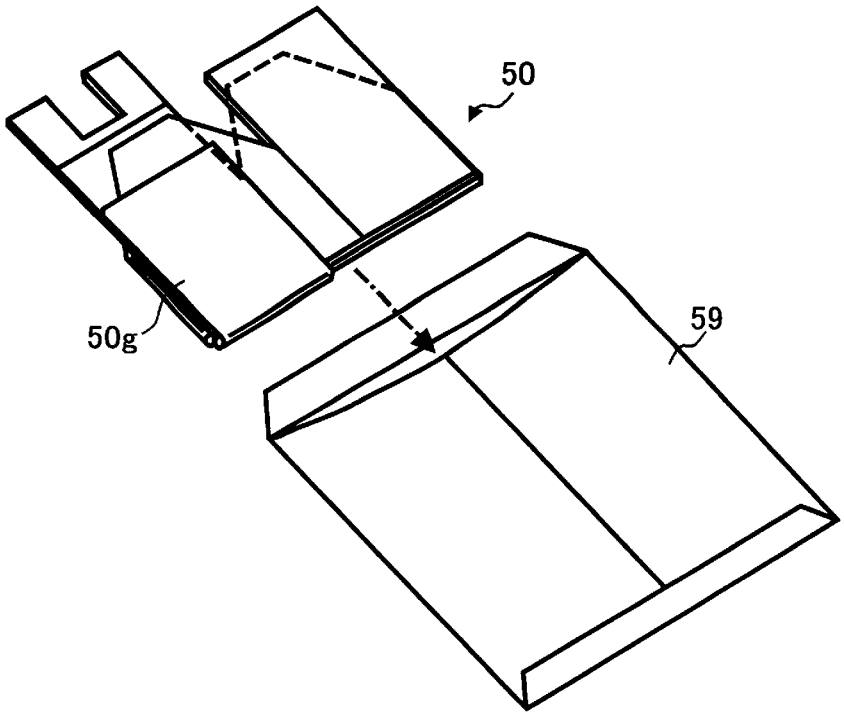
FIG. 13 is a yet another perspective view for explaining the procedure for folding the case.
Figure 14:
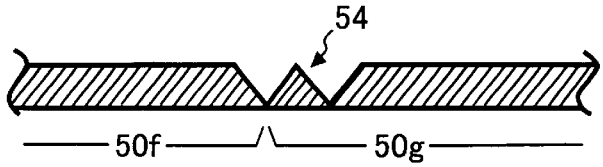
FIG. 14 is another cross-sectional view of a connected portion of two face plates of the case, in which a W-shape groove is formed.
Figure 15:
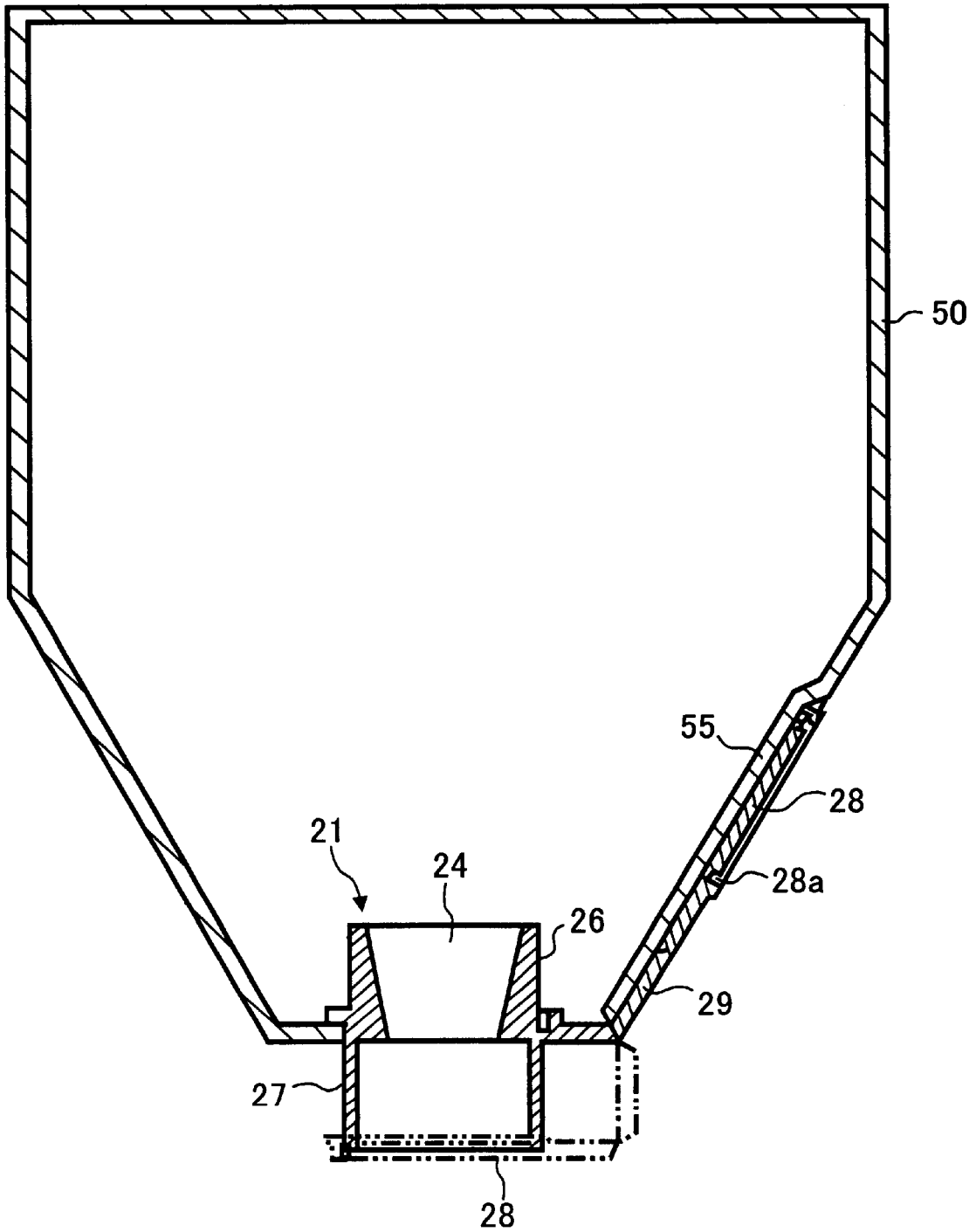
FIG. 15 is a cross-sectional view illustrating the toner container.

Further, by first developing the case 50 so that its outer surface faces upward, as illustrated in FIG. 11, and then, by folding back the case 50, as illustrated in FIG. 12, such that the face plate 50*c* may be stacked on the face plate 50*f*, the width-wise length of the case 50 can be halved. Thereby, as illustrated in FIG. 13, when the face plate 50*g* protruding downward is folded and stacked on the two-ply folded stack of the face plate 50*c* and the face plate 50*f*, the area occupied by the case 50 can be reduced without increasing the thickness thereof so much. Accordingly, the folded case 50 can be housed in an appropriately sized envelope 59. In this case, the face plate 50*g* to be folded last is stacked on the above-described two-ply folded stack of the face plate 50*c* and the face plate 50*f*. If the V-shaped groove 51 is formed at the connecting portion of the face plate 50*g* and the face plate 50*f*, the face plate 50*g* cannot be stacked on the two-ply folded face plate stack. Therefore, as illustrated in FIG. 14, a W-shaped groove 54 is formed at the connected portion of the face plate 50*g* and the face plate 50*f* instead of a V-shaped groove. Specifically, a V-shaped groove is formed at the connection portion and another V-shape groove is formed at the side of the face plate 50*g*, so that the W-shaped groove 54 is formed. By thus forming the W-shaped groove 54, the face plate 50*g* can be stacked on the on the two-ply folded face plate stack.

Furthermore, in the case 50, the face plate 50*d*, to which the base portion 21 of the toner bag 22 is mounted, has a guide receiving portion 58 formed integrally therewith as a linking recess, to which the sliding plate 25 of the base portion 21 is slidably mounted as illustrated in FIG. 4.

When mounting the toner bag 22 which is filled with toner to the case 50, the case 50 has been assembled in a box shape with only the face plates 50*a* and 50*b* opened. The toner bag 22 is inserted into the case 50 through the opening 55, as illustrated in FIG. 6, and then the face plates 50*a* and 50*b* are closed. That is, by closing the face plates 50*a* and 50*b* and fitting the engaging protrusion 52 into the engaging hole 53 with respect to the face plates 50*h*, the toner container 20 is completed.

The completed toner container 20 has a holding device for holding the face plate 50*b* in a closed state. The face plate 50*b*, along with the face plate 50*a*, is to be closed at the last stage of completing the container 20, so that these two face plates 50*a* and 50*b* make up the door member of the toner container 20 in this embodiment. In the embodiment illustrated in FIG. 16, the holding device for holding the face plate 50*b* is in the form of a sheet material 60, which is wound around a portion corresponding to the side face of the case 50. Although the sheet material 60 may be made of paper, in this embodiment it is formed of a thermal shrinkage sheet made of a resin film. The side face of the case 50 around which the sheet material 60 is wound is oriented in a direction to pass through both a rotation supporting side and a engaging side with the face plate 50*h*, of the face plate 50*b*. Reference numeral 64 indicates a projection acting as a positioning device for positioning the sheet material 60 and for preventing,a falling-off of the sheet material 60 in a ring state. The projection 64 is disposed so as to be come in contact with or in the vicinity of the upper and lower edges of the sheet material 60 of at least one face plate.

The toner container 20 is wound with the sheet material 60 to hold the face plate 50*b*, thus securely preventing the face plate 50*b* from being opened even if impacted by vibrations or due to falling-off during transportation.

Figure 16:
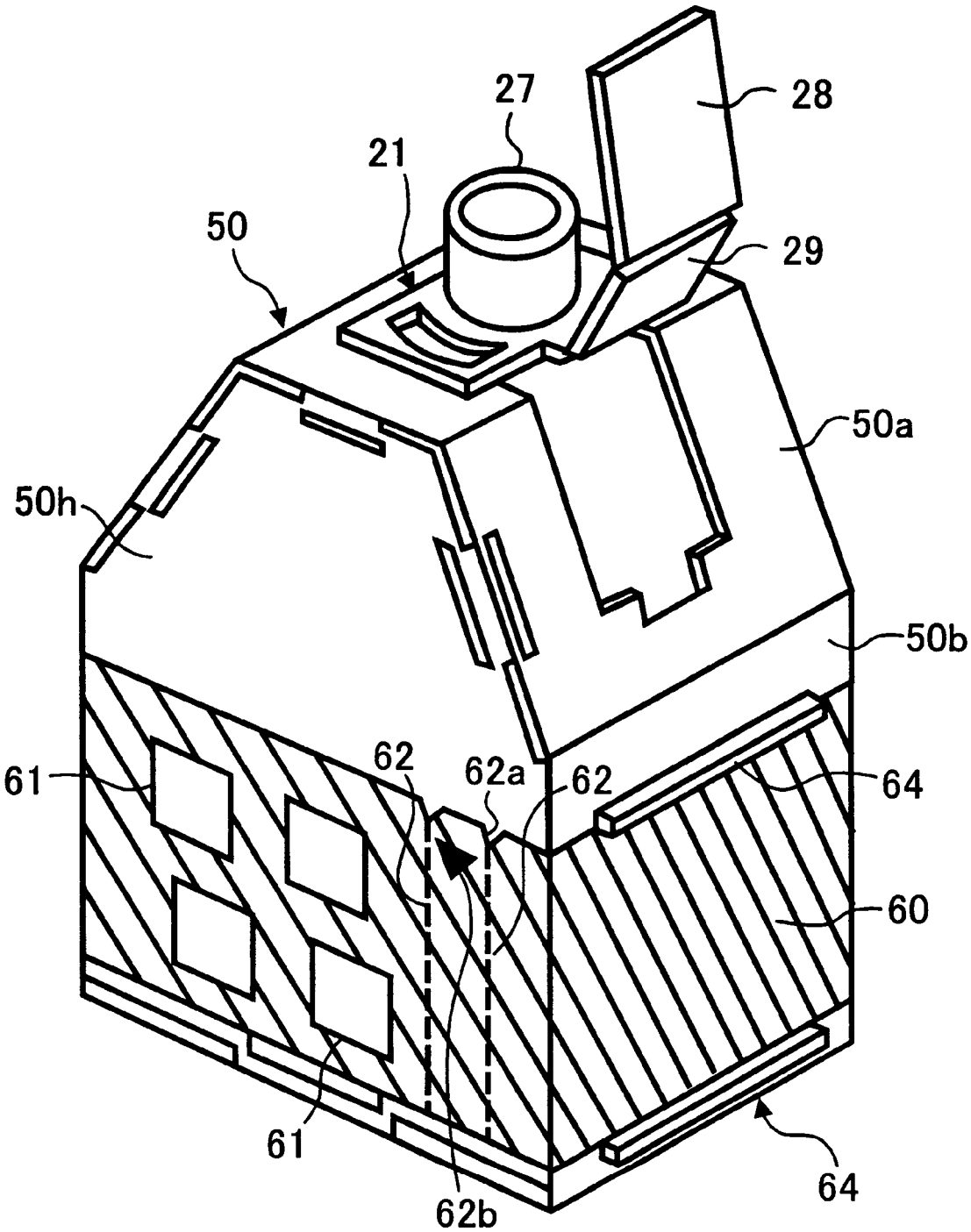
FIG. 16 is a perspective view illustrating the toner container with a sheet material wound around the case.

Because the toner container 20 according to the present invention is of a bag-in-box type, a user who first uses this toner container 20 in an image forming apparatus might in some cases mistake the case 50 for a packaging container and takes out the toner bag 22 from the case 50. To avoid such a problem, as illustrated in FIG. 16, the above-mentioned sheet material 60 has information 61 printed or otherwise displayed thereon by use of, e.g. an illustration of use, indicating that it is to be set as is to the setting portion of the image forming apparatus.

Thus, the user may be prevented from inadvertently disassembling the toner container 20.

Furthermore, when the toner container 20 is exhausted, it can be disassembled and then folded, as mentioned above. The folded case 50 can be then sent to a toner filling factory, which is very advantageous in transportation.

The disassembling and folding procedure may preferably be carried out by a sales shop etc., where the exhausted container has been collected from the user. If the container is to be disassembled at the sales shop, its employee must be fully familiar with how to disassemble it. However, it is difficult to teach him how to do so, leaving him unfamiliar with it in many cases. If, accordingly, he disassembles it, he may damage, e.g. the engaging portion of the case 50, or take a great deal of time to accomplish this.

To disassemble the toner container 20, first the sheet material 60 must be peeled off. Accordingly, the sheet material 60 has beforehand, as a means for promoting cutting for peel-off, a perforation 62, which is formed, e.g. in a direction perpendicular to the winding direction. This cutting promoting means may be a shrink wrap or notch, besides the perforation 62. Thus, the sheet material 60 can be easily peeled off at the perforation 62

Further, a grip piece 62*a* is formed for facilitating cutting along the perforation 62. When cutting along the perforation 62 by means of the grip piece 62*a*, almost all operators pull the grip piece 62*a* downward with the container is held in his left hand. Accordingly, by disposing the grip piece 62*a* on the side of the toner discharging portion 27, the operators can naturally cut the sheet material 60 with the toner discharging portion 27 facing upward. Moreover, the perforation 62 may have a mark 62*b* thereon for indicating the cutting direction. In addition, because the perforation 62 is given on the face plate 50*h* adjacent the opening side of the face plate 50*b* to be opened first and in the vicinity of the opening side of the face plate 50*b*, the operator can cut along the perforation 62 and then open the face plates 50*a* and 50*b* without changing the hand holding the case 50.

Figure 17:
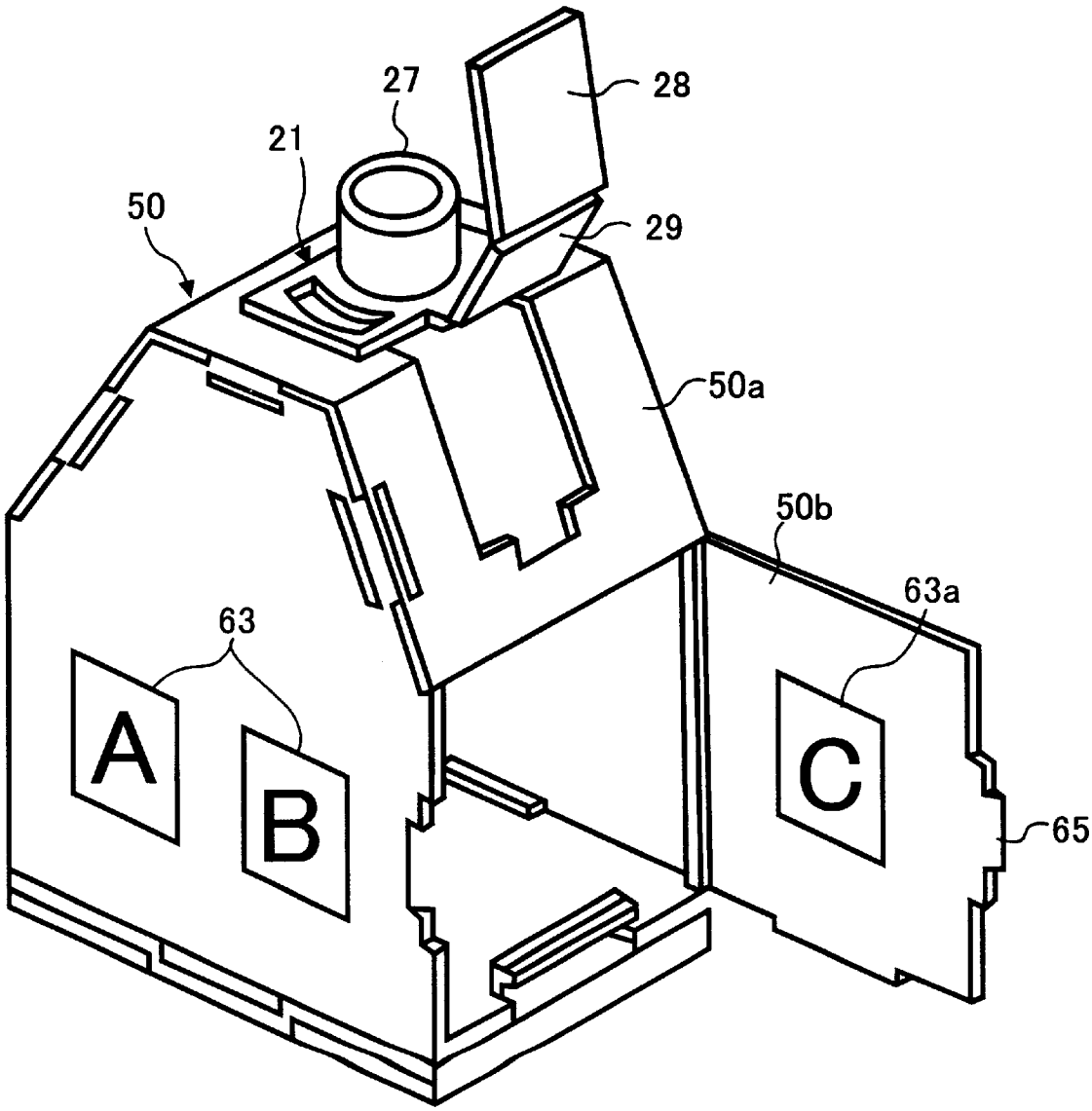
FIG. 17 is a perspective view illustrating the toner container with its sheet material removed and a door member opened.

To disassemble the container 20 after the sheet material 60 is peeled off, first the face plates 50*a* and 50*b* must be opened to thereby take out the toner bag 22 to then return the case 50 to its developed state. Therefore, the face plate 50*b* has a finger engagement 65 formed at the disconnecting side thereof to aid disassembling, as illustrated in FIG. 17, and the finger engagement 65 appears when the sheet material 60 is peeled off. Further, in this embodiment, as illustrated in FIG. 17, information 63 about the disassembling procedure etc. is written at a portion which appears when the sheet material 60 is peeled off. Therefore, even when an unskilled operator disassembles the toner container 20, the operator can disassemble the toner container 20 without misunderstanding the procedure by reading that information.

Further, in this embodiment, information 63*a* on the face plate to be opened next is indicated on the side of the back side of the face plate 50*b* to be opened first. By thus indicating, on the face plate that has been opened, information on the face plate to be opened next, any one can simply disassemble the toner container 20. Therefore, it is possible to provide such a sales system that the user may buy only the toner bag 22 for replacement or that the toner bag 22 may be replaced at the sales shop etc.

Figure 18:
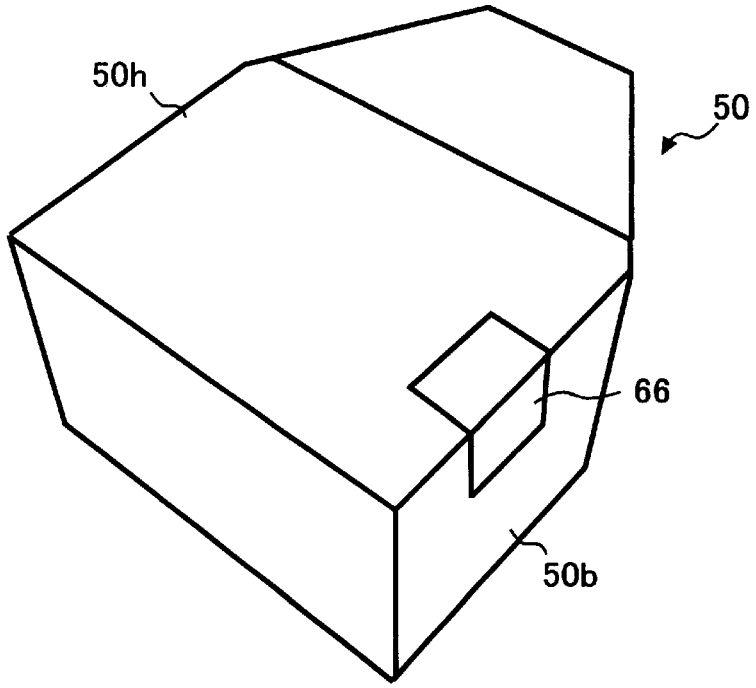
FIG. 18 is a perspective view illustrating another toner container.

If the user or the sales shop replaces the toner bag 22, the above-mentioned sheet material 60 must be wound around the completed toner container 20. This requires a facility to enable the winding of the sheet material 60. For avoiding the requirement of such facility, a pasting seal 66 as illustrated in FIG. 18 may be used as the holding means for holding the face plate 50*b* in a closed state. In this case, the seal 66 is to be pasted over a boundary between the face plates 50*b* and 50*h* of the case 50.

When the toner bag 22 is empty after use of the toner, after the toner container 20 is taken out of the image forming apparatus, the sheet material 60 etc. can be peeled off so that the exhausted toner bag 22 can be easily taken out from the case 50. Then, the case 50 can be folded so as to be smaller in size as mentioned above. Thereby, transportation and storage of the toner container 20 are facilitated, an advantage of a smaller housing space required for transportation and storage is enhanced, thus greatly decreasing the costs for collection and distribution from the users to the manufacturer. Moreover, the case 50 can be made of such a material that has some durability to thereby enable repetitive use of the case 50, thus reducing the cost of the toner container 20 greatly.

The toner bag 22 is also collected for recycling. Because the toner bag 22 is flexible, it can be reduced in volume greatly, thus reducing along with the case 50 the transportation costs greatly.

The toner container 20 configured as described above can take on any volume-reducible form, when exhausted, because the toner bag 22 is flexible. Further, the case 50 can be folded small or be developed so as to be plate shaped, so that it can take on an appropriate form for transportation and storage as occasion demands. Therefore, as compared to a hard case, the case 50 can greatly improve handling in transportation and storage, thus greatly reducing the cost of collection and distribution from the users to the manufacturer. If the toner bag 22, the base portion 21, and the seal valve 23 are made of the same material or a material of the same base, it is advantageous because they need not be discriminated from each other for recycling.

Figure 19:
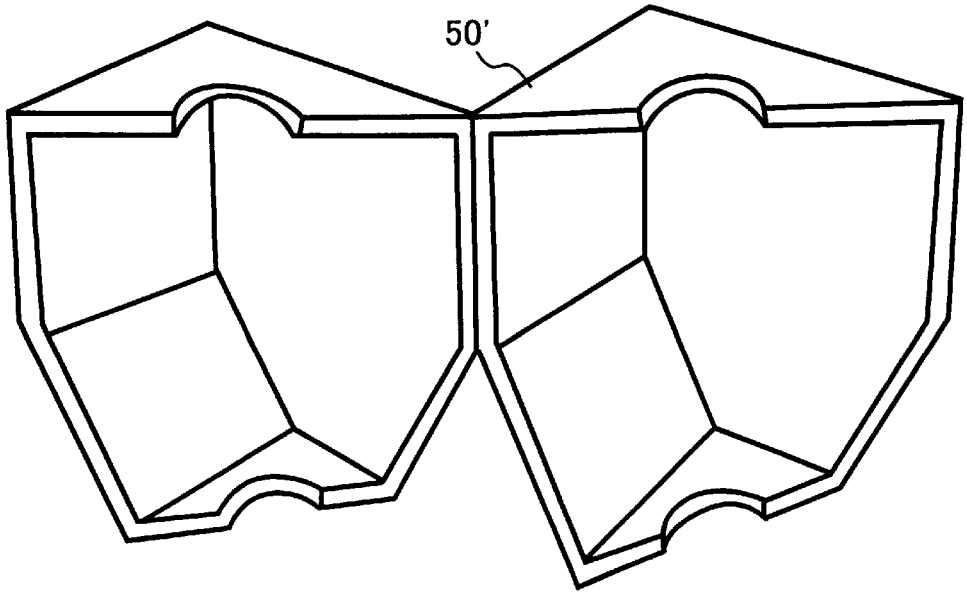
FIG. 19 is a perspective view illustrating still another toner container.

The case 50 provided with the opening 55 as illustrated in FIG. 3 is not limited to the above-mentioned development type. For example, as illustrated in FIG. 19, a case 50 which can be divided into two parts or such a case that can be pressed and crashed may be employed.

Numerous additional modifications and variations of the present invention are possible in light of the above teachings. It is therefore to be understood that within the scope of the appended claims, the present invention may be practiced otherwise as specifically described herein.

The present application claims priority and contains subject matter related to Japanese Patent Applications No. 2000-188135 and No. 2001-124312 filed in the Japanese Patent Application on Jun. 22, 2000 and Apr. 23, 2001, respectively, the entire contents of each of which are hereby incorporated by reference.

What is claimed is:

1. A powder container comprising:

a deformable inner bag for containing powder;

a case having an inner space large enough to house said deformable inner bag, said case having a rigidity greater than a rigidity of said deformable inner bag, said case having an opening through which said deformable inner bag passes to be attached to and detached from said case; and a door member having first and second sides, said first side of said door member being mounted to said case in a rotatable manner and the second side of said door member being engaged with said case in an engaging/disengaging manner.

2. The powder container according to claim 1, wherein:

said case comprises a polyhedron having at least four face plates; and said opening is formed at a position corresponding to at least one of said face plates which is large enough to form said opening, when opened, so that said bag passes therethrough from one direction so as to be one of attachable to and detachable from said case.

3. A powder container comprising:

a deformable inner bag for containing powder;

a case having an inner space large enough to house said deformable inner bag, and said case having a rigidity greater than a rigidity of said deformable inner bag;

an opening formed in said case for any one of attaching said deformable inner bag to and detaching said deformable inner bag from said case by passing said deformable inner bag through said opening in said case; and a door member for opening and closing said opening, wherein a first side of said door member is mounted to said case in a rotatable manner and a second side of said door member is engaged with said case in an engaging/disengaging manner.

4. The powder container according to claim 3, further comprising a holding device for holding said door member in a closed state.

5. The powder container according to claim 4, wherein said holding device comprises a sheet material arranged so as to pass through said second side of said door member.

6. The powder container according to claim 5, wherein said sheet material is wound around said case in a winding direction so as to pass said first side and said second side of said door member.

7. The powder container according to claim 5, wherein said sheet material comprises any one of a group consisting of written, printed, drawn, and otherwise displayed information about said sheet material.

8. The powder container according to claim 5, wherein said sheet material has information thereon for disassembly of said case.

9. The powder container according to claim 5, wherein a portion of said case covered by said sheet material has an auxiliary shape for disassembly of said case, said auxiliary shape being a finger engagement of said at least first face plate of said at least four face plates.

10. The powder container according to claim 5, wherein said sheet material includes information for cutting said sheet material off of said case in a direction different from a winding direction in which said sheet material is wound around said case.

11. The powder container according to claim 10, wherein said information for cutting said sheet material off of said case is provided on a face plate of said at least four face places of said case, said face place being provided adjacent to and in proximity with said second side of said door member.

12. The powder container according to claim 10, wherein both said information for cutting said sheet material off of said case and a portion of said deformable inner bag from which a powder is discharged are positioned so as to be oriented in substantially a same direction.

13. The powder container according to claim 5, wherein said sheet material comprises any of one of a group consisting of paper and film.

14. The powder container according to claim 5, wherein a member defining a position at which said sheet material is wound around said case is provided on said case, said member being a projection projecting from said at least first face plate of said at least four face plates.

15. The powder container according to claim 5, wherein said holding device comprises a seal pasted on an engaging side of said door member.

16. The powder container according to claim 15, wherein said seal is pasted over a boundary between said door member and a face plate of said at least four face plates adjusted to said second side of said door member of said case.

17. The powder container according to claim 3, wherein:

said case comprising said polyhedron is plate shaped prior to being folded into a three-dimensional polyhedron shape; and said door member is closable at a last stage of a procedure for assembling said case.

18. The powder container according to claim 3, wherein:

said case comprises a polyhedron having at least four face plates;

said opening is formed at a position corresponding to at least one of said face plates, which is large enough to form said opening such that said bag passes therethrough from one direction to be attached to and detached from said case; and said door member comprising the face plate provided at a position corresponding to said opening.

19. An image forming apparatus, comprising:

a developing device; and a powder container including:

a deformable inner bag for containing powder;

a case having an inner space large enough to house said deformable inner bag, said case having a rigidity greater than a rigidity of said deformable inner bag;

a door member having first and second sides, said first side of said door member being mounted to said case in a rotatable manner and the second side of said door member being engaged with said case in an engaging/disengaging manner; and wherein said powder container comprises a toner container in which a toner is contained in said deformable inner bag, said toner being replenishable to said developing device from said toner container.

20. The image forming apparatus according to claim 19, wherein:

said case comprises a polyhedron having at least four face plates; and said opening is formed at a position corresponding to a first face plate, of said at least four face plates, which is large enough to form said opening, when opened, so that said deformable inner bag passes therethrough from one direction for being any one of attached to or detached from said case.

21. An image forming apparatus, comprising:

a developing device;

a powder container including:

a deformable inner bag for containing powder;

a case having an inner space large enough to house said deformable inner bag, and said case having a rigidity greater than said deformable inner bag;

an opening formed in said case through which said deformable inner bag passes in order for said deformable inner bag to be attached to and detached from said case;

a door member for opening and closing said opening, said door member having first and second sides, said first side of said door member being mounted to said case in a rotatable manner and the second side of said door member being engaged with said case in an engaging/disengaging manner; and wherein said powder container comprises a toner container in which a toner is contained in said deformable inner bag, said toner being replenishable to said developing device from said toner container.

22. The image forming apparatus according to claim 21, wherein said powder container further includes a holding device for holding said door member in a closed state.

23. The image forming apparatus according to claim 22, wherein said holding device is a sheet material arranged so as to pass said second side of said door member.

24. The image forming apparatus according to claim 23, wherein said sheet material is wound around said case in a winding direction so as to pass said first side and said second side of said door member.

25. The image forming apparatus according to claim 23, wherein said sheet material comprises any one of a group consisting of written, printed, drawn, and otherwise displayed information about said sheet material.

26. The image forming apparatus according to claim 23, wherein said sheet material includes information thereon regarding disassembly of said case.

27. The image forming apparatus according to claim 23, wherein a portion of said case covered by said sheet material has an auxiliary shape for disassembly of said case, said auxiliary shape being a finger engagement of said at least first face plate of said at least four face plates.

28. The image forming apparatus according to claim 23, wherein said sheet material includes information for cutting said sheet material off of said case in a direction different from a winding direction in which said sheet material is wound around said case.

29. The image forming apparatus according to claim 28, wherein said information for cutting said sheet material off of said case is provided on a face plate of said at least four face places of said case, said face place being provided adjacent to and in proximity with said second side of said door member.

30. The image forming apparatus according to claim 28, wherein both said information for cutting said sheet material off of said case and a portion of said deformable inner bag from which powder is discharged are positioned so as to be oriented in substantially a same direction.

31. The image forming apparatus according to claim 23, wherein said sheet material comprises any of one of a group consisting of paper and film.

32. The image forming apparatus according to claim 23, wherein a member for positioning a position at which said sheet material is wound around said case is provided on said case, said member being a projection projecting from said at least first face plate of said at least four face plates.

33. The forming apparatus according to claim 22, wherein said holding device coprises a seal pasted on said second side of said door member.

34. The image forming apparatus according to claim 33, wherein said seal is pasted over a boundary between said door member and a face plate of said at least four face plates adjacent to said second side of said door member of said case.

35. The image forming apparatus according to claim 21, wherein:

said case comprising said polyhedron is plate shaped prior to being folded into a three-dimensional polyhedron shape; and said door member is closable at a last stage of a procedure for assembling said case.

36. The image forming apparatus according to claim 21, wherein:

said case comprises a polyhedron having at least four face plates;

said opening is formed at a position corresponding to at least one of said face plates, which is large enough to form the opening such that said bag passes therethrough from one direction to be attachable to and detachable from said case; and said door member comprises the face plate provided at a position corresponding to said opening.

37. A powder container comprising:

powder containing means for containing a powder, said powder containing means being deformable; and housing means for housing said powder containing means, said housing means having an inner space large enough to house said powder containing means, said housing means having a rigidity greater than a rigidity of said powder containing means, said housing means being provided with an opening through which said powder containing means is attached to and detached from said case, and said housing means including a door member having first and second sides, said first side of said door member being mounted to said housing means in a rotatable manner and the second side of said door member being engaged with said housing means in an engaging/disengaging manner.

38. A powder container comprising:

powder containing means for containing a powder, said powder containing means being deformable;

housing means for housing said powder containing means, said housing means having an inner space large enough to house said powder containing means, and said housing means having a rigidity greater than a rigidity of said powder containing means;

an opening formed in said housing means through which said powder containing means passes in order for said powder containing means to be attached to and detached from said housing means; and opening/closing means for opening and closing said opening, said opening/closing means comprising said at least first face plate, of said at least four face plates, provided at a position so as to close said opening, and said opening/closing means being a door member having first and second sides, said first side of said door member being mounted to said housing means in a rotatable manner and the second side of said door member being engaged with said housing means in an engaging/disengaging manner.

39. An image forming apparatus, comprising:

a developing device; and a powder container including:

powder containing means for containing a powder, said powder containing means being deformable;

housing means for housing said powder containing means, said housing means having an inner space large enough to house said powder containing means, said housing means having a rigidity greater than a rigidity of said powder containing means, said housing means having an opening through which said powder containing means passes in order to be attached to and detached from said case, said powder containing means comprising a toner container in which a toner is contained, said toner being replenished to said developing device from said toner container, and said housing means including a door member having first and second sides, said first side of said door member being mounted to said housing means in a rotatable manner and the second side of said door member being engaged with said housing means in an engaging/disengaging manner.

40. A method for forming a powder container, said method comprising the steps of:

forming deformable powder containing means for containing a powder;

forming housing means for housing said deformable powder containing means therewithin, said housing means being formed so as to have an inner space large enough to house said deformable powder containing means, and said housing means having a rigidity greater than a rigidity of said deformable powder containing means; and providing said housing means with an opening through which said deformable powder containing means is attachable to said housing means and detachable from said housing means by passing said deformable powder containing means through said opening, and said housing means including a door member having first and second sides, said first side of said door member being mounted to said housing means in a rotatable manner and the second side of said door member being engaged with said housing means in an engaging/disengaging manner.

41. A method for forming a powder container, said method comprising the steps of:

forming deformable powder containing means for containing a powder;

forming housing means for housing said deformable powder containing means within said housing means, said housing means being formed so as to have an inner space large enough to house said deformable powder containing means, and said housing means having a rigidity greater than a rigidity of said deformable powder containing means; and forming an opening in said housing means for passing said deformable powder containing means therethrough in order to attach said deformable powder containing means to and detach said deformable powder containing means from said housing means, said opening being openable and closable, and said housing means including a door member having first and second sides, said first side of said door member being mounted to said housing means in a rotatable manner and the second side of said door member being engaged with said housing means in an engaging/disengaging manner.

* * * * *

UNITED STATES PATENT AND TRADEMARK OFFICE

CERTIFICATE OF CORRECTION

PATENT NO. : 6,532,352 B2
DATED : March 11, 2003
INVENTOR(S) : Katsuyama

It is certified that error appears in the above-identified patent and that said Letters Patent is hereby corrected as shown below:

Title page,
Item [30], Foreign Application Priority Data, should read:
-- [30] Foreign Application Priority Data

Jun. 22, 2000 (JP) ..... 2000-188135
Apr. 23, 2001 (JP) ..... 2001-124312 --

Signed and Sealed this

Twenty-fourth Day of June, 2003

JAMES E. ROGAN
*Director of the United States Patent and Trademark Office*